US008275524B2

(12) United States Patent
Krause et al.

(10) Patent No.: US 8,275,524 B2
(45) Date of Patent: Sep. 25, 2012

(54) SYSTEM AND METHOD FOR LIMITING OPERATOR CONTROL OF AN IMPLEMENT

(75) Inventors: Steven R. Krause, Chillicothe, IL (US); Eric J. Dishman, Peoria, IL (US); Wayne A. Lamb, Chillicothe, IL (US); Erik J. Eddington, Bartonville, IL (US)

(73) Assignee: Caterpillar Inc., Peoria, IL (US)

( * ) Notice: Subject to any disclaimer, the term of this patent is extended or adjusted under 35 U.S.C. 154(b) by 455 days.

(21) Appl. No.: 12/645,619

(22) Filed: Dec. 23, 2009

(65) Prior Publication Data

US 2011/0153171 A1 Jun. 23, 2011

(51) Int. Cl.
*G06F 7/00* (2006.01)

(52) U.S. Cl. ..... 701/50; 701/36; 37/414

(58) Field of Classification Search ..... 701/36, 701/50; 37/352–362, 382, 414–416, 234, 37/907

See application file for complete search history.

(56) References Cited

U.S. PATENT DOCUMENTS

| | | | |
|---|---|---|---|
| 4,263,973 | A | 4/1981 | Boulais et al. |
| 4,273,196 | A | 6/1981 | Etsusaki et al. |
| 5,446,980 | A | 9/1995 | Rocke |
| 5,467,829 | A | 11/1995 | Barton et al. |
| 5,764,511 | A | 6/1998 | Henderson |
| 5,860,480 | A | 1/1999 | Jayaraman et al. |
| 6,278,955 | B1 | 8/2001 | Hartman et al. |
| 6,655,465 | B2 | 12/2003 | Carlson et al. |
| 6,954,999 | B1 * | 10/2005 | Richardson et al. ..... 37/348 |
| 7,007,415 | B2 | 3/2006 | Koch |
| 2005/0107898 | A1 | 5/2005 | Gannon et al. |
| 2006/0123673 | A1 | 6/2006 | Glover |
| 2008/0213075 | A1 | 9/2008 | Sjogren et al. |
| 2009/0056961 | A1 | 3/2009 | Gharsalli et al. |
| 2009/0069987 | A1 | 3/2009 | Omelchenko et al. |

FOREIGN PATENT DOCUMENTS

| | | |
|---|---|---|
| EP | 1889537 | 2/2008 |
| WO | 9426988 | 11/1994 |

OTHER PUBLICATIONS

Co-pending U.S. Appl. No. 12/542,908; Implement Control System for a Machine, filed Aug. 18, 2009.

Co-pending U.S. Appl. No. 12/645,599; System and Method for Controlling An Implement to Maximize Machine Productivity and Project a Final Grade, filed Dec. 23, 2009.

* cited by examiner

*Primary Examiner* — Richard M. Camby
(74) *Attorney, Agent, or Firm* — Leonard Stewart

(57) ABSTRACT

The disclosure describes, in one aspect, an implement control system that includes a controller operatively connected to an implement. The controller is adapted to receive a signal from an input device indicative of a desired implement movement by an operator and to receive an automatically generated signal indicative of an automatically determined implement movement. The controller is further adapted to determine whether to move the implement based on the input device signal or the automatically generated signal. The controller is adapted to generate a control signal to move the implement based on the input device signal when a portion of the implement is above a desired cutting plane.

20 Claims, 4 Drawing Sheets

SYSTEM AND METHOD FOR LIMITING OPERATOR CONTROL OF AN IMPLEMENT

TECHNICAL FIELD

This patent disclosure relates generally to an implement control system, and more particularly to systems and methods for limiting operator control of an implement.

BACKGROUND

Earthmoving machines such as track type tractors, motor graders, loaders, and scrapers have an implement such as a dozer blade or bucket, which is used on a worksite in order to alter a geography or terrain of a section of earth. The implement may be controlled by an operator or by a control system to perform work on the worksite as the earthmoving machine moves over the worksite.

Positioning the implement, especially to achieve final surface contour or grade, can be a complex and time-consuming task requiring expert skill and diligence. Thus, it is often desirable to provide autonomous control of the implement to simplify operator control. Nevertheless, known autonomous systems do not have a mode where the operator is the primary controller of the implement and the control system provides a limiting function of the operator commands.

The disclosed systems and methods are directed to overcoming one or more of the problems set forth above.

SUMMARY

The disclosure describes, in one aspect, an implement control system that includes a controller operatively connected to an implement. The controller is adapted to receive a signal from an input device indicative of a desired implement movement by an operator and to receive an automatically generated signal indicative of an automatically determined implement movement. The controller is further adapted to determine whether to move the implement based on the input device signal or the automatically generated signal. the controller is adapted to generate a control signal to move the implement based on the input device signal when a portion of the implement is above a desired cutting plane.

The disclosure describes, in one aspect, a method for controlling an implement. The method includes receiving a signal from an input device indicative of a desired implement movement by an operator and receiving an automatically generated signal indicative of an automatically determined implement movement. The method further includes determining whether to move the implement based on the input device signal or the automatically generated signal. The method includes generating a control signal to control the position of the implement based on the input device signal when a portion of the implement is above a desired cutting plane.

BRIEF DESCRIPTION OF THE DRAWING(S)

FIG. 1 schematic illustrates a machine having an implement control system in accordance with an exemplary embodiment of the present disclosure.

FIG. 2 schematic illustrates an implement control system in accordance with an exemplary embodiment of the present disclosure.

DETAILED DESCRIPTION

Figure 1:
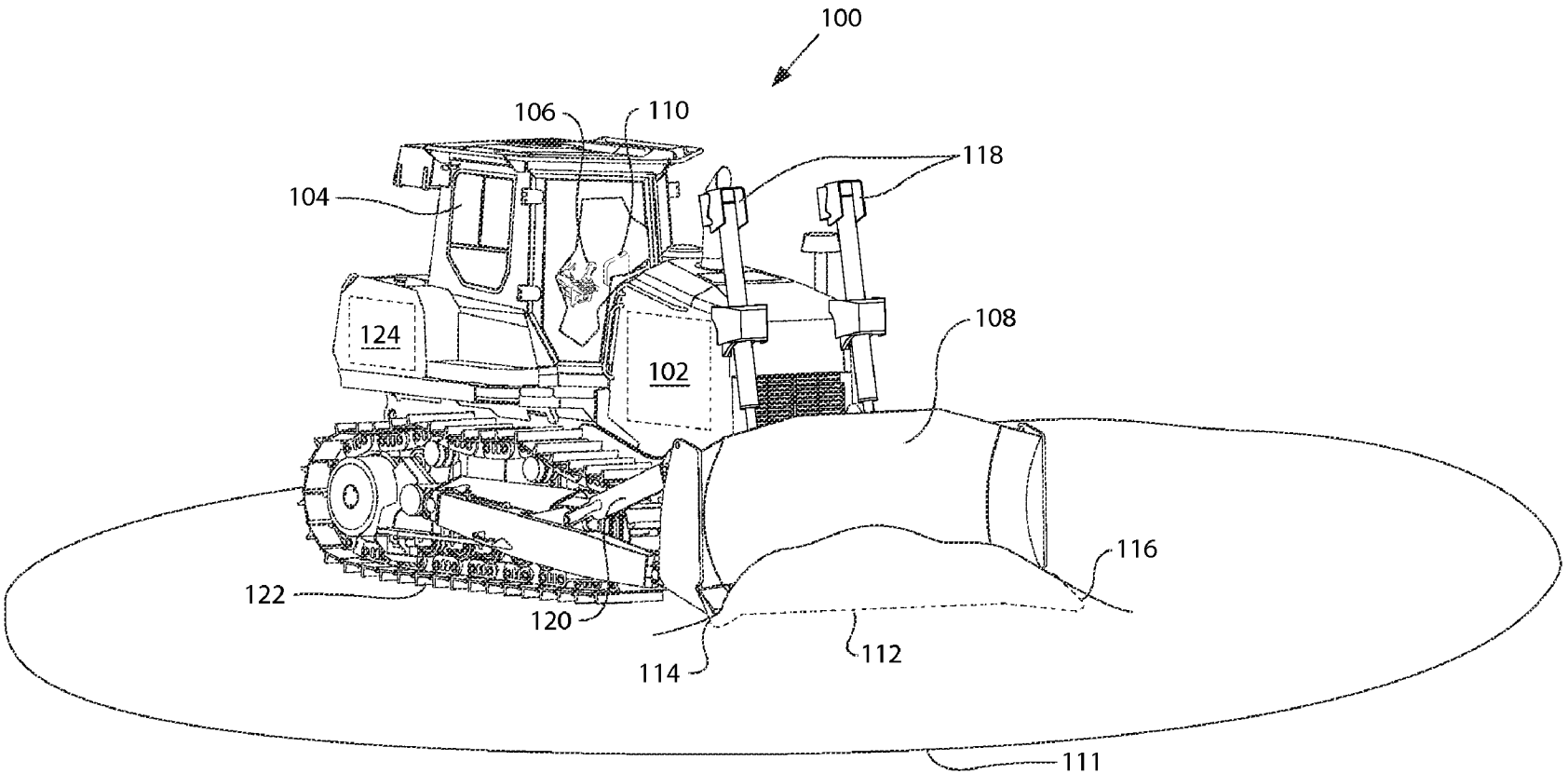

This disclosure relates to systems and methods for limiting operator control of an implement. An exemplary embodiment of a machine 100 is shown schematically in FIG. 1. The machine 100 may be a mobile vehicle that performs some type of operation associated with an industry such as mining, construction, farming, transportation, or any other industry known in the art. For example, the machine 100 may be a tractor or dozer, as shown in FIG. 1, a motor grader, a loader, a scraper, or any other vehicle or machine known in the art that alters a geography or terrain.

The machine 100 includes a power source 102, an operator station or cab 104 containing controls necessary to operate the machine 100, such as, for example, one or more input devices 106 for propelling the machine 100 or controlling other machine components. The machine 100 further includes a work tool or implement 108, such as, for example, a blade for moving earth. The one or more input devices 106 may include one or more joysticks, levers, buttons, and other actuators, disposed within the cab 104 and may be adapted to receive input from an operator indicative of a desired implement 108 movement. For simplification purposes, only one input device 106 embodied as a joystick will be discussed and shown in the figures.

In some embodiments, the cab 104 may also include a user interface 110 having a display for conveying information to the operator and may include a keyboard, touch screen, or any suitable mechanism for receiving input from the operator to control or operate the machine 100, the implement 108, and/or other machine components. Alternatively, or additionally, the operator may be located outside of the cab and/or some distance away from the machine 100 and control the machine 100, the implement 108, and/or other machine components remotely from that location.

The implement 108 may be adapted to engage, cut, or penetrate the surface of a worksite 111 and to move the earth to accomplish a predetermined task. The worksite 111 may include, for example, a mine site, a landfill, a quarry, a construction site, or any other type of worksite. Moving the earth may be associated with altering the geography at the worksite 111 and the predetermined task may include, for example, a grading operation, a scraping operation, a leveling operation, a bulk material removal operation, or any other type of geography altering operation at the worksite 111.

In the illustrated embodiment, the implement 108 includes a cutting edge 112 that extends between a first end 114 and a second end 116. The first end 114 of the cutting edge 116 of the implement 108 may represent a right tip or right edge of the implement 108 and the second end 114 of the cutting edge 112 of the implement 108 may represent a left tip or left edge of the implement 108. The implement 108 may be moveable by one or more hydraulic mechanisms operatively connected with the input device 106 in the cab 104.

The hydraulic mechanisms may include one or more hydraulic lift actuators 118 and one or more tilt actuators 120 for moving the implement 108 in various positions, such as, for example, lifting the implement 108 up or lowering the implement 108 down, tilting the implement 108 left or right, or pitching the implement 108 forward or backward. In some embodiments, the machine 100 includes one hydraulic lift actuator 118 and one hydraulic tilt actuator 120 on each side of the implement 108. In the illustrated embodiment, two hydraulic lift actuators 118 are shown, but only one of the two hydraulic tilt actuator 120 is shown (that is, only one side of the machine is shown).

The power source 102 may embody an engine for providing power to a ground engaging mechanism 122 adapted to support the machine 100 and functions to steer and propel the machine 100. The power source 102 may embody an engine such as, for example, a diesel engine, a gasoline engine, a gaseous fuel-powered engine, or any other type of combustion engine known in the art. It is contemplated that the power source 102 may alternatively embody a non-combustion source of power (not shown) such as, for example, a fuel cell, a power storage device, or another suitable source of power. The power source 102 may produce a mechanical or electrical power output that may be converted to hydraulic power for providing power to the machine 100, the implement 108, and to the other machine 100 components.

Figure 2A:
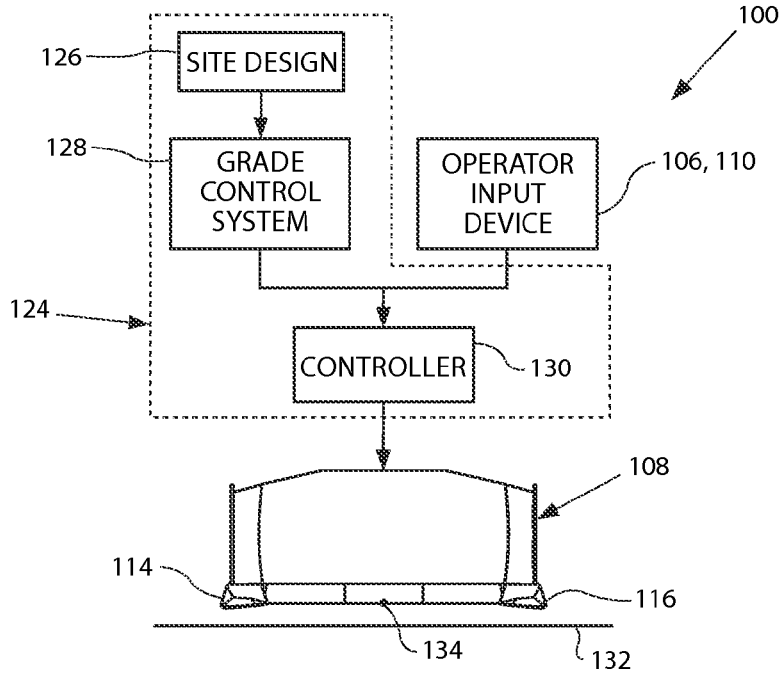
Figure 2B:
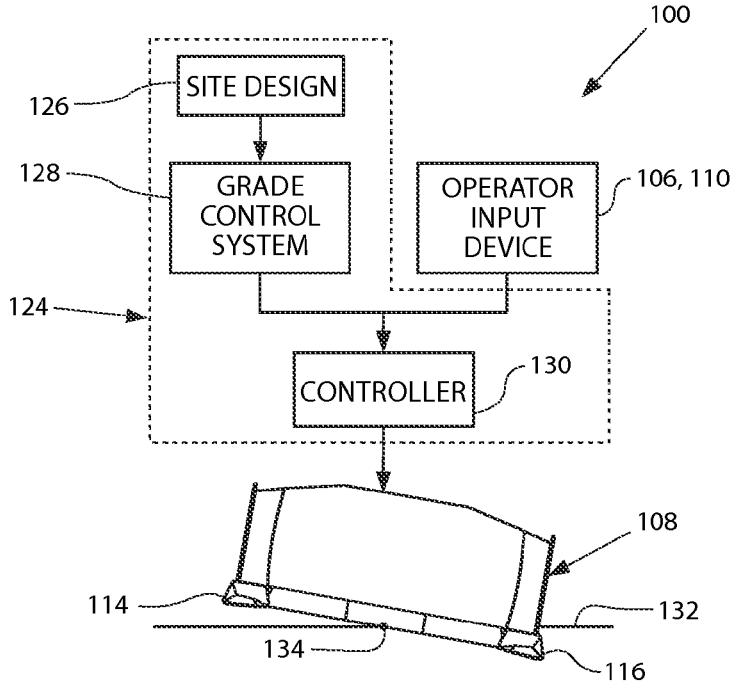

The machine 100 further includes an implement control system 124 operatively connected to the input device 106 and the hydraulic mechanisms 118, 120 for controlling movement of the implement 108. As illustrated in FIGS. 2A and 2B, the implement control system 124 includes a site design 126, a grade control system 128, and a controller 130 adapted to receive inputs from the input device 106 and inputs from the grade control system 128 and adapted to control the movement of the implement 108 based on the inputs from the input device 106 and/or the grade control system 128. In one embodiment, the implement control system 124 may include one or more controllers 130. For simplification purposes, however, only one controller 130 is discussed and shown in the figures.

The controller 130 may direct the implement 108 to move to a predetermined or target position in response to an input signal received from the input device 106 indicative of the position representing the operator's desired movement of the implement 108. The position signals indicative of the operator's desired movement of the implement 108 may include elevational signals, such as, lower implement and raise implement. The position signals indicative of the operator's desired movement of the implement 108 may also include tilt signals, such as, tilt left or tilt right.

In some embodiments, the tilt left and tilt right movements of the implement 108 may be accomplished by using the one or more input devices 106 to independently move the first end 114 of the cutting edge 112 or to independently move the second end 116 of the cutting edge 112. In some embodiments, moving the first end 114 may be accomplished by using one of the one or more input devices 106, such as, for example, using a right cylinder height lever (not shown), and moving the second end 116 may be accomplished by using another of the one or more input devices 106, such as, for example, using a left cylinder height lever (not shown). Alternatively, or additionally, moving the first end 114 and moving the second end 116 may be accomplished by using the same input device 106, embodied in a joystick as shown in the FIG. 1. Nevertheless, in other embodiments, the position signals do not include tilt signals.

The controller 130 alternatively, or additionally, may direct the implement 108 to move to a predetermined or target position in response to an input signal received from the grade control system 128 that is indicative of an automatically determined movement of the implement 108. The automatically determined movement of the implement 108 may be based on input from the site design 126. The position signals indicative of the automatic movement of the implement 108 may also include elevational signals, such as, lower implement and raise implement. The position signals indicative of the automatic movement of the implement 108 may or may not also include tilt signals, such as, tilt left or tilt right, as is discussed in detail above.

The site design 126 includes data related to the construction surface of the worksite based on engineering design. The construction surface provided in the site design 126 may represent a ground profile that can be indicative of an irregular three-dimension (3D) surface or a flat plane. In the illustrated embodiment, the construction surface is a design plane 132 that represents the desired cutting plane or the desired final grade for the worksite 111.

In some embodiments, the grade control system 128 may be adapted to determine a relative location or position of the machine 100 within in the worksite 111. In other embodiments, the grade control system 128 may be adapted to determine a relative location or position of the implement 108 based on the location or position of the machine 100 within the worksite 111. The relative location or position of the machine 100 and/or the implement 108 may be determined using one or more position sensors, GPS receivers, and/or laser systems, which are well-known in the art.

In the illustrated embodiment, the grade control system 128 receives input from the site design 126 indicative of the design plane 132 for the worksite 111 and determines the corresponding target position of the implement 108 relative to the design plane 132. The controller 130 receives an input from the grade control system 128 indicative of the target position generated by the grade control system 128 based on the relative position of the implement 108 to the design plane 132. The target position represents the position of the implement 108 required to engage the implement 108 with the terrain of the worksite 111 to achieve the design plane 132.

The controller 130 also receives an input from the input device 106 indicative of the operator's desired position of the implement 108 for engaging the implement 108 with the terrain of the worksite 111. The controller 130 is adapted to receive the target position signal generated by the grade control system 128 and the target position signal generated by the input device 106 and to generate a control signal or command to move the implement 108 to the corresponding grade control system 128 target position or to the corresponding input device 106 target position based on the relative position of the implement 108 to the design plane 132. The control signal to move the implement 108 may be applied to actuate the hydraulic mechanisms 118, 120 to move the implement 108 to the corresponding target position.

The controller 130 may be adapted to evaluate the relative position of the implement 108 and the design plane 132 by comparing the relative location of a portion of the cutting edge 112 of the implement 108 to the design plane 132. In the illustrated embodiment, the portion of the cutting edge 112 is disposed at about the center 134 of the cutting edge 112 of the implement 108 between the first end 114 and the second end 116. The controller 130 may determine whether the portion 134 is above the design plane 132 or, on or below the design plane 132. The controller 130 may be adapted to determine whether to control the movement of the implement 108 based on the inputs from the input device 106 or based on the inputs from the grade control system 128 depending on whether the center 134 is above, on, or below the design plane 132.

In other embodiments, the controller 130 may be adapted to evaluate the relative position of the implement 108 and the design plane 132 by comparing the relative location of a plurality of portions of the cutting edge 112 of the implement to the design plane 132. The plurality of the portions of the cutting edge 112 may include the portion disposed at about the center 134 of the cutting edge 112 and the portions of the cutting edge 112 disposed at about the first end 114 and/or at about the second end 116.

As shown in FIG. 2B, the second end 116 of the cutting edge 112 is below the design plane 132, while both the first end 114 of the cutting edge 112 and the center 134 of the cutting edge 112 are above and on the design plane 132 respectively. The controller 130 may be adapted to determine whether to control the movement of the implement 108 based on the inputs from the input device 106 or based on the inputs from the grade control system 128 depending on whether the center 134 is above, on, or below the design plane 132 and/or whether the first and second ends 114, 116 are above, on, or below the design plane 132.

The grade control system 128 and the controller 130 may include one or more control modules (e.g. ECMs, ECUs, etc.). The one or more control modules may include processing units, memory, sensor interfaces, and/or control signal interfaces (for receiving and transmitting signals). The processing units may represent one or more logic and/or processing components used by the implement control system 124 to perform certain communications, control, and/or diagnostic functions. For example, the processing units may be adapted to execute routing information among devices within and/or external to the implement control system 124.

Further, the processing units may be adapted to execute instructions from a storage device, such as memory. The one or more control modules may include a plurality of processing units, such as one or more general purpose processing units and or special purpose units (for example, ASICS, FPGAs, etc.). In certain embodiments, functionality of the processing unit may be embodied within an integrated microprocessor or microcontroller, including integrated CPU, memory, and one or more peripherals. The memory may represent one or more known systems capable of storing information, including, but not limited to, a random access memory (RAM), a read-only memory (ROM), magnetic and optical storage devices, disks, programmable, erasable components such as erasable programmable read-only memory (EPROM, EEPROM, etc.), and nonvolatile memory such as flash memory.

INDUSTRIAL APPLICABILITY

The industrial applicably of the systems and methods for limiting operator control of an implement described herein will be readily appreciated from the foregoing discussion. Although the machine is shown as a track-type tractor, the machine may be any type of machine that performs at least one operation associated with for example mining, construction, and other industrial applications. Moreover, the systems and methods described herein can be adapted to a large variety of machines and tasks. For example, backhoe loaders, skid steer loaders, wheel loaders, motor graders, scrapers, and many other machines can benefit from the systems and methods described. Thus, the present disclosure is applicable to many machines and in many environments.

In accordance with certain embodiments, the implement control system 124 is adapted to compare the target position signal generated by the grade control system 128 and the target position signal generated by the input device 106 and to generate a control signal to move the implement 108 to the corresponding grade control system 128 target position or to the corresponding input device 106 target position based on the relative position of the implement 108 to the design plane 132.

Figure 3:
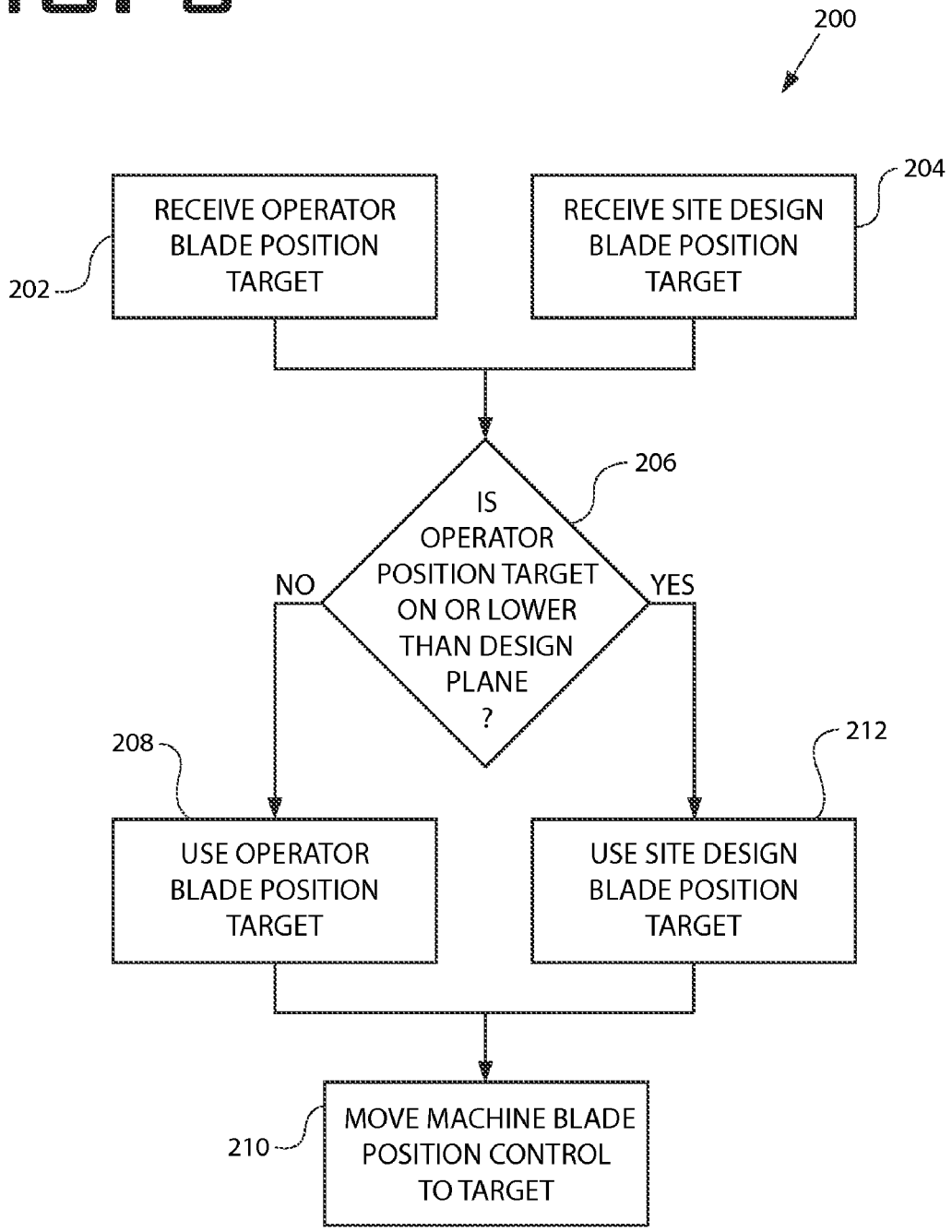
FIG. 3 is a flow diagram illustrating one embodiment of implement control process in accordance with an exemplary embodiment of the present disclosure.

FIG. 3 illustrates an exemplary embodiment of the implement control process and the operation of the implement control system (200). The controller 130 is adapted to receive the target position signal generated by the input device 106 indicative of the operator's desired position of the implement 108 (Step 202). The controller 130 is further adapted to receive the target position signal generated by the grade control system 128 indicative of the position of the implement 108 required to engage the terrain of the worksite 111 to achieve the design plane (Step 204). The controller compares the relative input device 106 target position signal to the design plane 132 and determines whether the input device 106 target position signal represents a relative position on or below the design plane 132 or a relative position above the design plane 132 (Step 206).

If the relative input device 106 target position signal is above the design plane 132, as shown in FIG. 2A (Step 206: No), the controller 130 uses the input device 106 target position signal (Step 208) to move the implement 108 to the target position indicative of the operator's desired position (Step 210). If the relative input device 106 target position signal is on or below the design plane 132 (Step 206: Yes), the controller 130 uses the grade control system 128 target position signal (Step 212) to move the implement 108 to the target position indicative of the automatically determined movement of the implement 108 from the site design 126 (Step 210).

Figure 4:
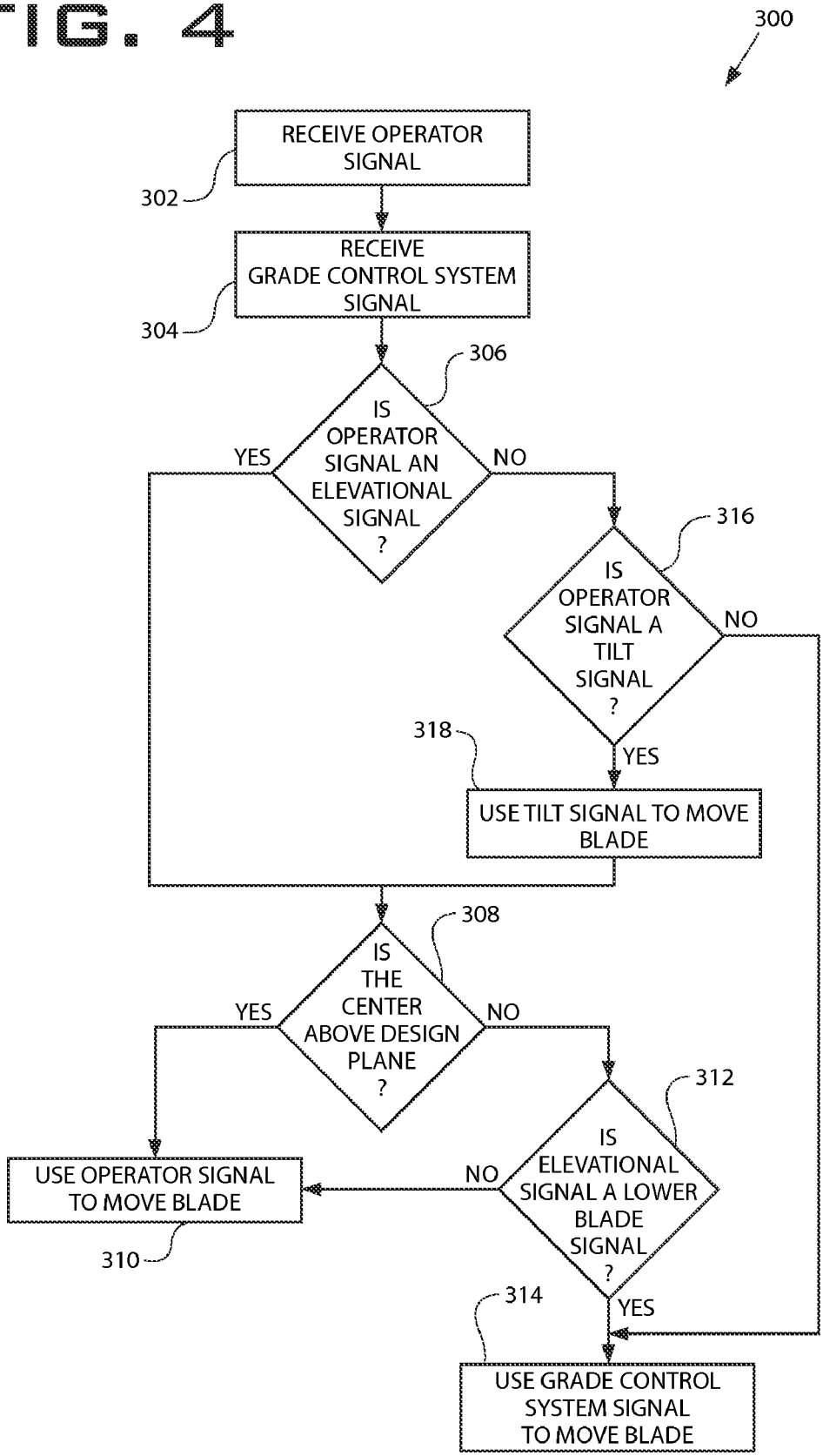
FIG. 4 is a flow diagram illustrating one embodiment of the implement control process in accordance with an exemplary embodiment of the present disclosure.

FIG. 4, in accordance with the disclosed invention, illustrates another embodiment of the implement control process and the operation of the implement control system (300). The controller 130 is adapted to receive a target position signal from the input device 106 indicative of the operator's desired movement of the implement 108 (Step 302). The controller 130 is further adapted to receive a target position signal automatically generated by the grade control system 128 according to the site design 126 (Step 304).

The controller 130 determines whether the operator target position signal represents an elevational signal, such as, for example, a lower implement signal or a raise implement signal (Step 306). If the operator target position signal is the elevational signal (Step 306: Yes), the controller compares the relative position representative of the operator target position signal to the design plane 132 and determines whether the operator target position signal represents a relative position wherein the center portion 134 of the implement 108 is either on or below the design plane 132 or the center portion 134 is above the design plane 132 (Step 308).

If the position representative of the relative operator target position signal is above the design plane 132 (Step 308: Yes), the controller 130 uses the elevational signal and moves the implement 108 to the position representative of the operator target position signal (Step 310). If, however, the relative operator target position signal represents a relative position wherein the center portion 134 of the implement is on or below the design plane 132 (Step 308: No), the controller determines whether the elevational signal is the lower implement signal (Step 312).

If the elevational signal is not the lower implement signal, that is, the raise implement signal (Step 312: No), the controller 130 uses the elevational signal (the raise implement signal) and moves the implement 108 to the position representative of the operator target position signal (Step 310). If, however, the elevational signal is the lower implement signal (Step 312: Yes), the controller 130 uses the site design 126 target position signal generated by the grade control system 128 and moves the implement to the corresponding position (Step 314).

Nevertheless, if the operator target position signal is not the elevational signal (Step 306: No), the controller determines whether the operator target position signal is a tilt signal, such as, for example, a tilt implement left signal or a tilt implement right signal (Step 316). If the operator target position signal is a tilt signal (Step 316: Yes), the controller 130 is adapted to compare the relative operator target position signal to the design plane 132 and to determine whether the operator target position signal represents a relative position wherein the first end 114 or the second end 116 of the implement 108 is either on or below the design plane 132.

Whether the first end 114 or the second end 116 is on or below the design plane 132 corresponds with or is associated with whether the tilt signal is the tilt implement left signal or the tilt implement right signal. Nevertheless, the controller 130 uses the tilt implement signal and moves the implement to the corresponding position (Step 318) even if the first end 114 or the second end 116 is on or below the design plane 132. As shown in FIG. 2B, the second end 116 corresponding with or associated with the tilt left signal is permitted to be moved below the design plane 132. The center portion 134, however, must remain above the design plane 132. Therefore, the controller is adapted to monitor whether center portion 134 is above the design plane and control the implement 108 based on the relative position of the center portion of the implement to the design plane 132 (that is, return to Step 308 to continue the control sequence related to elevational movement of the implement 108).

It will be appreciated that the foregoing description provides examples of the disclosed systems and methods. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An implement control system, the implement control system comprising:

a controller operatively connected to an implement, the controller adapted to:

receive a signal from an input device indicative of a desired implement movement by an operator;

receive an automatically generated signal indicative of an automatically determined implement movement;

determine whether to move the implement based on the input device signal or the automatically generated signal; and generate a control signal adapted to move the implement based on the input device signal when a portion of the implement is above a desired cutting plane.

2. The implement control system of claim 1, wherein the automatically generated signal moves the implement when the portion of the implement is on or below the desired cutting plane.

3. The implement control system of claim 2, wherein the input device signal represents a lower implement signal.

4. The implement control system of claim 2, wherein the input device signal represents a tilt implement signal and the controller is adapted to move the implement based on the tilt implement signal even when the portion of the implement is on or below the desired cutting plane.

5. The implement control system of claim 4, wherein the portion of the implement is a region disposed at about the center of a cutting edge of the implement disposed between a first end and a second end of the cutting edge and the controller is adapted to move the implement based on the tilt implement signal even when the center of the cutting edge is on or below the desired cutting plane.

6. The implement control system of claim 5, wherein the controller is adapted to move the implement based on the tilt implement signal even when either the first end or the second end is on or below the desired cutting plane.

7. The implement control system of claim 3, wherein the automatically generated signal represents at least one of a lower implement signal, a raise implement signal, or a tilt implement signal.

8. The implement control system of claim 1, wherein the portion of the implement is defined as a region disposed at about the center of a cutting edge of the implement between a first end and a second end.

9. The implement control system of claim 1, wherein the automatically generated signal is based on a GPS system that provides the desired cutting plane.

10. A method for controlling an implement, the method comprising:

receiving a signal from an input device indicative of a desired implement movement by an operator;

receiving an automatically generated signal indicative of an automatically determined implement movement;

determining whether to move the implement based on the input device signal or the automatically generated signal; and generating a control signal adapted to control the position of the implement based on the input device signal when a portion of the implement is above a desired cutting plane.

11. The method of claim 10, further comprising moving the implement based on the automatically generated signal when the portion of the implement is on or below the desired cutting plane.

12. The method of claim 11, wherein the input device signal is a lower implement signal.

13. The method of claim 11, further comprising moving the implement based on the input device signal even when the portion of the implement is on or below the desired cutting plane, wherein the input device signal represents a tilt implement signal.

14. The method of claim 13, wherein the portion of the implement is a region disposed at about the center of a cutting edge of the implement between a first end and a second end of the cutting edge and either the first end or the second end is on or below the desired cutting plane.

15. The method of claim 11, wherein the automatically generated signal is at least one of a lower implement signal, a raise implement signal, or a tilt implement signal.

16. The method of claim 10, wherein the portion of the implement is defined as a region disposed at about the center of a cutting edge of the implement between a first end and a second end.

17. The method of claim 10, wherein the automatically generated signal is based on a GPS system that determines the desired cutting plane.

18. A machine, comprising:

an implement;

an implement control system configured to limit operator control of the implement, the implement control system comprising:

a controller operatively connected to the implement, the controller adapted to:

receive a signal from an input device indicative of a desired implement movement by an operator;

receive an automatically generated signal indicative of an automatically determined implement movement;

determine whether to move the implement based on the input device signal or the automatically generated signal; and generate a control signal adapted to move the implement based on the input device signal when a portion of the implement is above a desired cutting plane.

19. The machine of claim 18, wherein the automatically generated signal moves the implement when the portion of the implement is on or below the desired cutting plane.

20. The machine of claim 19, wherein the input device signal represents a tilt implement signal and the controller is adapted to move the implement based on the tilt implement signal even when the portion of the implement is on or below the desired cutting plane.

* * * * *